US005709150A

United States Patent [19]

Dürr et al.

[11] Patent Number: 5,709,150

[45] Date of Patent: Jan. 20, 1998

[54] DEVICE FOR ASSEMBLING, DISMANTLING AND TRANSPORTING EASILY BENT, ARC-SHAPED OBJECTS WITH FOLDED SUSPENSION EDGES

[75] Inventors: Reinhold Rudolf Dürr, Würzburg; Bernhard Walter Wolfgang Muth, Veitshöccheim, both of Germany

[73] Assignee: Koenig & Bauer-Albert Aktiengesellschaft, Germany

[21] Appl. No.: 669,391

[22] PCT Filed: Jan. 17, 1995

[86] PCT No.: PCT/DE95/00046

§ 371 Date: Jul. 17, 1996

§ 102(e) Date: Jul. 17, 1996

[87] PCT Pub. No.: WO95/19262

PCT Pub. Date: Jul. 20, 1995

[30] Foreign Application Priority Data

Jan. 17, 1994 [DE] Germany ..... 44 01 110.5
Jul. 14, 1994 [DE] Germany ..... 44 24 931.4

[51] Int. Cl.[6] ..... B41F 1/28

[52] U.S. Cl. ..... 101/415.1; 101/477

[58] Field of Search ..... 101/415.1, 477, 101/486

[56] References Cited

U.S. PATENT DOCUMENTS

| | | | |
|---|---|---|---|
| 4,191,105 | 3/1980 | Ohlsson . | |
| 4,727,807 | 3/1988 | Suzuki et al. . | |
| 5,259,314 | 11/1993 | Sugiyama | 101/477 |
| 5,331,892 | 7/1994 | Sieb et al. | 61/477 |
| 5,443,006 | 8/1995 | Beisel et al. . | |
| 5,495,805 | 3/1996 | Beisel et al. . | |
| 5,537,926 | 7/1996 | Beisel et al. | 101/477 |

FOREIGN PATENT DOCUMENTS

| | | |
|---|---|---|
| 28 04 970 | 8/1978 | Germany . |
| 41 30 359 | 3/1993 | Germany . |
| 1-176558 | 7/1989 | Japan . |

*Primary Examiner*—Eugene H. Eickholt
*Attorney, Agent, or Firm*—Jones, Tullar & Cooper, P.C.

[57] ABSTRACT

A device for mounting, removing and transporting an easily bendable device, such as a printing plate, to and from a plate cylinder includes a printing plate preparation device which supports the plate, and a cross arm with a plate gripper and pressing assembly. A gripper portion of the plate gripper and pressing assembly acts on the plate and is movable toward and away from a suspension strip of a cylinder.

15 Claims, 12 Drawing Sheets

DEVICE FOR ASSEMBLING, DISMANTLING AND TRANSPORTING EASILY BENT, ARC-SHAPED OBJECTS WITH FOLDED SUSPENSION EDGES

FIELD OF THE INVENTION

The present invention relates to a device for mounting, removing and transporting of easily bendable curved objects with suspension edges, preferably printing plates, on and from a cylinder of a rotary printing press.

DESCRIPTION OF THE PRIOR ART

DE 28 04 970 A1 describes a device for mounting and removing printing plates in a rotary printing press.

In this case a suction element performs a linear movement between a delivery roller and a plate cylinder and in this way transports the printing plate.

This suction element is fastened by means of cylinders on a carriage driven by a chain. By means of this cylinder, the suction element can perform a tilting movement at right angles in respect to the carriage movement for lifting and lowering the printing plate. For assembly, the suction element fixes a beveled front edge of the printing plate in place by switching on the suction effect. The suction element together with the plate is lifted by means of the cylinder and moved in the direction toward the plate cylinder by the carriage with the chain drive. A positioning table is located between the delivery roller and the plate cylinder, on which the printing plate is placed and positioned. Thereafter, the suction element again picks up the printing plate and transports it to a groove of the plate cylinder. The beveled edge of the printing plate is inserted into this groove of the plate cylinder by lowering the suction element.

After the suction effect has been turned off, the plate cylinder turns together with the printing plate which is simultaneously wound off the delivery roller. Once the printing plate is almost completely wound off the delivery roller, the suction element grips a rear of the printing plate and guides it into a further groove of the plate cylinder.

It is disadvantageous in connection with this, device that it is necessary to deposit and position the printing plate on a positioning table which is located between the delivery cylinder and the plate cylinder. It is possible for tolerances, for example because of play in the carriage guidance, to occur during the transport of the printing plate from the positioning table to the cylinder and during the suspension process of the printing plate in the cylinder, which cause an erroneous axial position of the printing plate on the cylinder.

U.S. Pat. No. 4,727,807 A describes a device for mounting and removing printing plates in a rotary printing press. In this case, a manipulation device which picks up the printing plates is moved by a robot between a preparation device and a plate cylinder. Four suction grippers, by means of which the printing plate is held, are rigidly disposed on the manipulation device.

For assembly, the printing plate is moved from the preparation device to the plate cylinder by multi-axial movements of the robot and is suspended with a beveled edge in a clamping channel of the cylinder.

The axial positioning of the printing plate takes place via a drive which is regulated by means of force sensors. Subsequently, four pressure rollers are applied by pivoting the manipulation device. The printing plate is placed on the plate cylinder by rotating the plate cylinder and a further end is inserted into the channel.

It is disadvantageous with this device that the manipulation unit must be movable and pivotable in several directions in the radial plane of the plate cylinder and that complicated drives and controls are required for this. It is furthermore not possible to transport and mount or remove several printing plates per cylinder simultaneously.

SUMMARY OF THE INVENTION

It is the object of the present invention to provide a device for mounting, removing and transporting easily bendable, curved objects with suspension edges, preferably printing plates, whose respective legs form an angle of less than 90° and which have no recesses for register pins, without a device for pre-positioning, for example a positioning table, and without a robot, and which allows operation and maintenance without hindrance and also makes possible free access to the print units as well, and assures a secure axial positioning of the printing plate.

This object is attained in accordance with the invention by means of a plate preparation device which is situated near the plate cylinder. A cross arm carries at least one gripper and pressing device and is movable in a transport plane which is generally parallel to a tangent of the plate cylinder. A gripper unit of the gripping and pressing device is equipped with suction strips which act on the printing side of the printing plate. This gripper unit is movable toward and away from a suspension strip of the cylinder and is movable parallel to an axis of rotation of the cylinder along the suspension edge of the cylinder. A printing plate fixed on the gripper unit can be pressed against lateral register stops on the suspension strip of the cylinder.

In a particularly advantageous manner, an exact axial positioning of a printing plate on a cylinder parallel with the axis of rotation of the cylinder against lateral register stops takes place by means of a defined force, for example by a force generated by prestressed springs, or by pneumatic cylinders. Thus no sensor and drive regulation are necessary. Furthermore, the position of the printing plate on the cylinder is independent of the exactness of the feed devices and therefore is extremely exact.

In an advantageous manner, the beveled suspension edges of the printing plate can have legs with an opening angle alpha of less than 90°, because of which it is possible to employ symmetrically designed closures with pivotable clamping flaps. These closures allow running of the machine both in the right and the left running direction of the cylinder.

By means of the tangential arrangement of a preparation device in respect to the cylinder, in an advantageous manner a gripper and pressing device only performs a linear movement for transporting the printing plate from the preparation device to the cylinder.

An inking unit protector is embodied as the preparation device in a space-saving manner, and the gripper and pressing device remains in a parked position in the printing unit in the vicinity of the cylinder, where it is protected against dirt and ink spatters.

BRIEF DESCRIPTION OF THE DRAWINGS

The device in accordance with the present invention is represented in the drawings and will be described in more detail in what follows.

Shown are in.

DESCRIPTION OF THE PREFERRED EMBODIMENT

Figure 1:
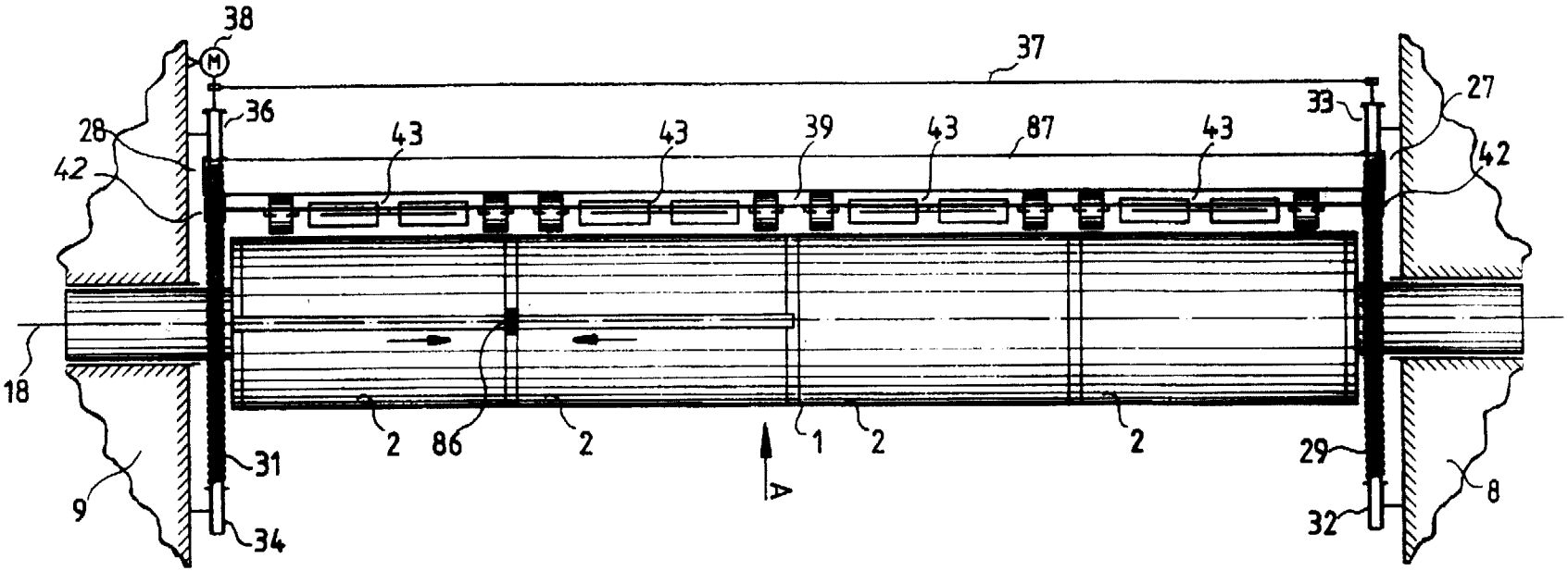
FIG. 1, a schematic representation of the device in accordance with the present invention in a top view, FIG. 2, a schematic representation of a gripper and pressing device of the device in accordance with the present invention in FIG. 1, FIGS. 3 to 11, schematic lateral views of the device in accordance with the present invention with associated cylinder and preparation devices in various operating positions, and FIG. 12, a schematic section through a closure of the cylinder.

FIG. 1 shows a cylinder 1 of a rotary printing press with easily bendable curved objects 2, preferably printing plates 2.

Figure 4:
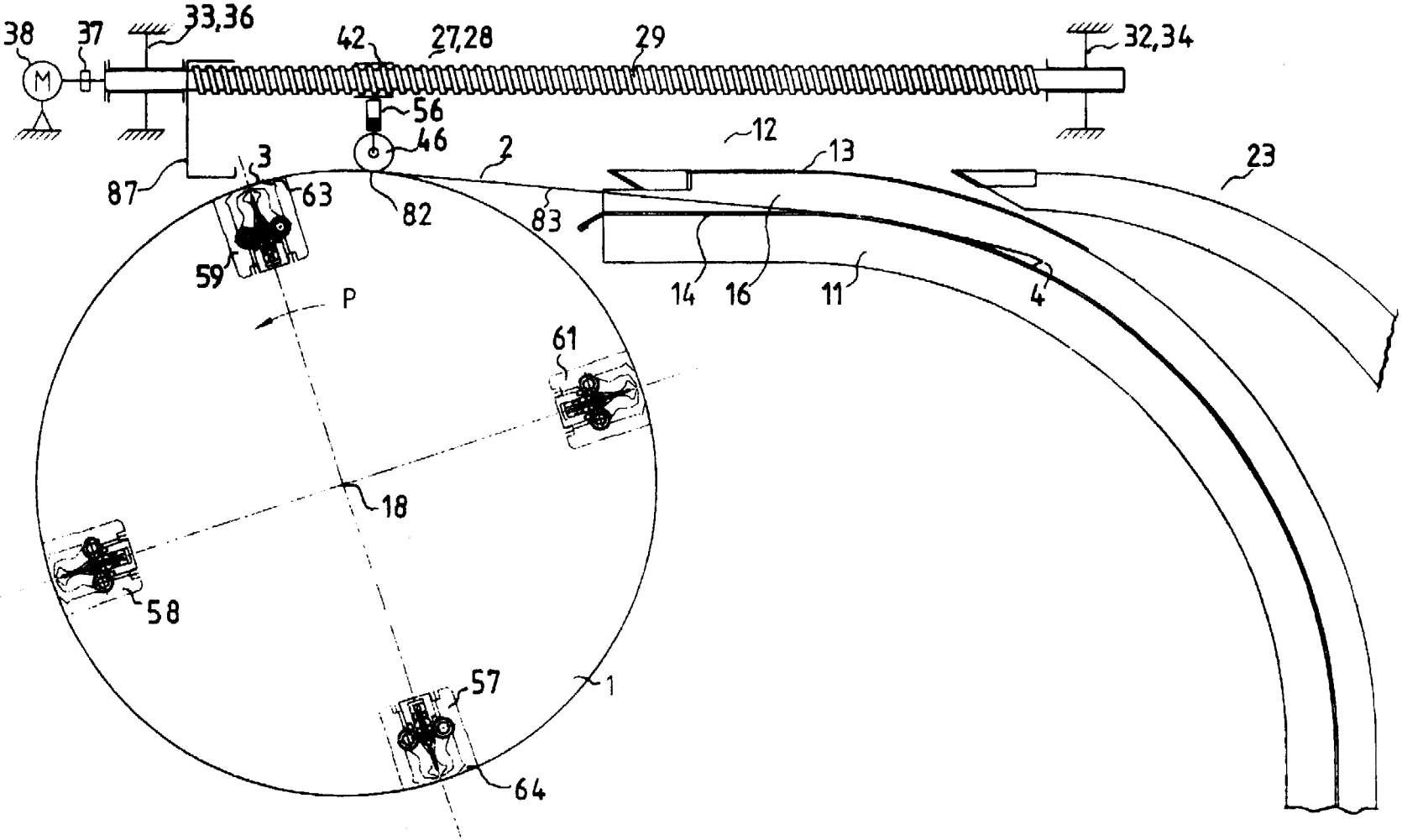

Respectively beveled front and rear suspension edges 3, 4 are disposed on opposite ends of every easily bendable curved object 2 as may be seen in FIG. 4 and, whose respective legs 6, 7 form an opening angle alpha of less than 90°. These beveled suspension edges 3, 4 are embodied to be dimensionally stable, i.e. these beveled suspension edges 3, 4 are not bent open when clamping the objects 2 on the cylinder 1. This object 2 designed in this manner can also consist of rubber blankets provided with beveled suspension edges 3, 4.

These dimensionally stable beveled suspension edges 3, 4 of the rubber blankets can be beveled edges of a metal plate, on which the rubber blanket is fastened by adhesion between the materials, for example glued or vulcanized. It is also possible for particularly the textile inserts of the rubber blanket to be made of CFK (carbon fiber reinforced plastic) or GFK (glass-fiber reinforced plastic) and the beveled suspension edges 3, 4 to be formed from this. For simplification, the described object is hereinafter called printing plate 2.

Figure 3:
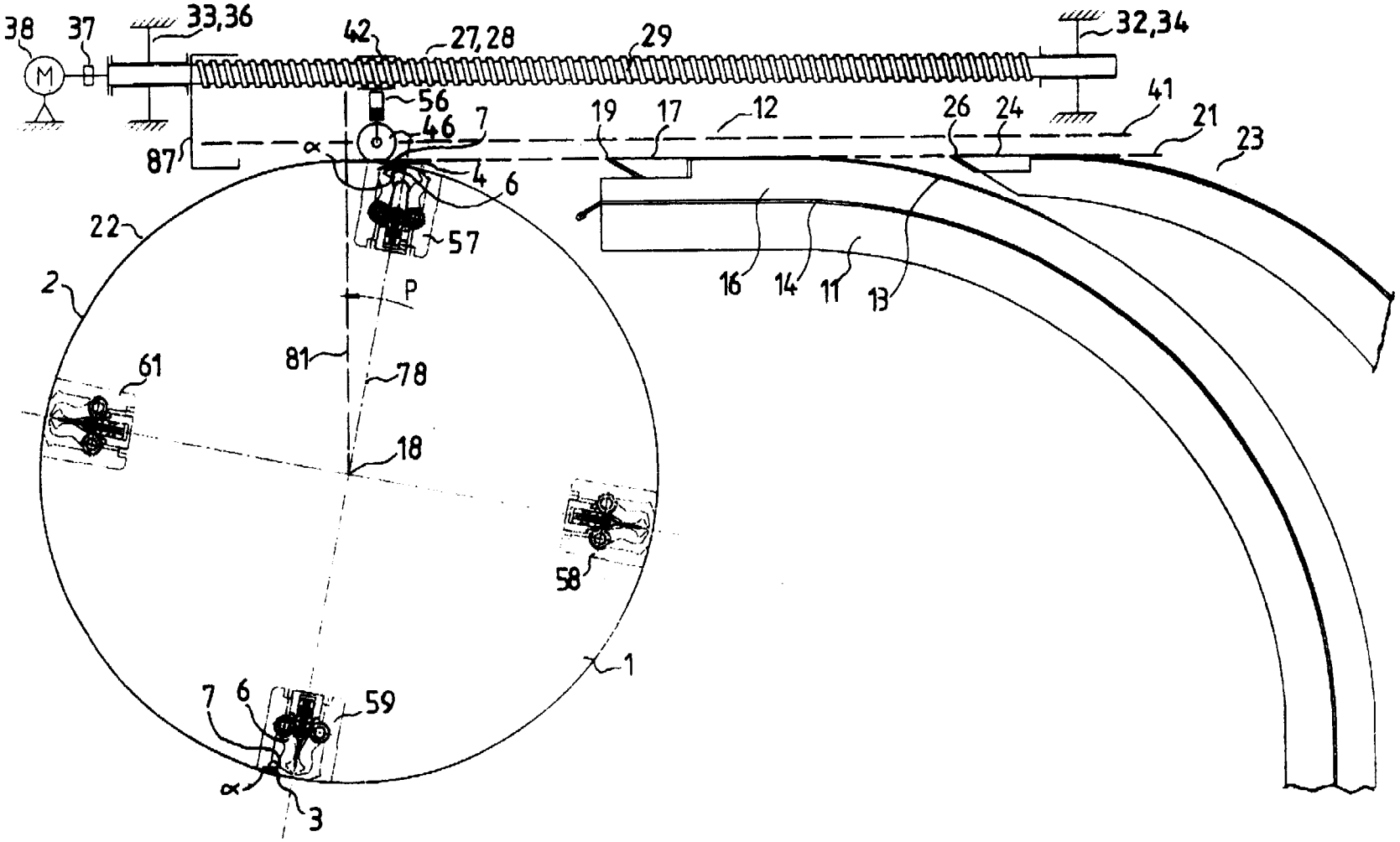
Figure 9:
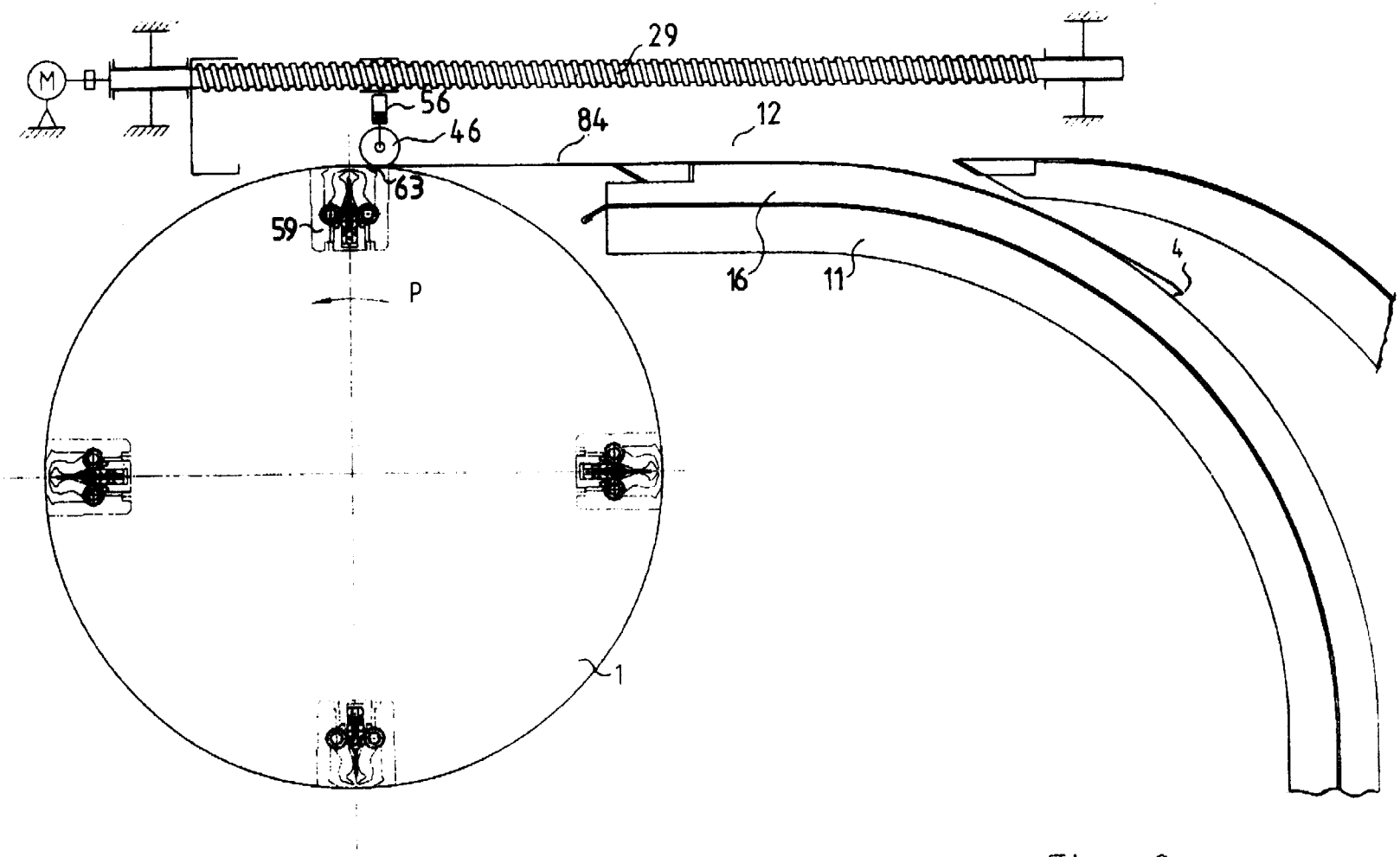

An inking unit protector 11, which is located close to the cylinder, as seen in FIG. 3, fixed in the frame, and which is embodied as a first printing plate preparation device 12, is associated with the cylinder 1 of the rotary printing press, which is seated in two side frames 8, that are shown in FIG. 1 9.

This printing plate preparation device 12 has an upper wall 13 and a lower wall 14, located opposite the upper, which together form a chute 16. A suspension strip 19 of nose-shaped cross section, which extends over the width of the cylinder 1 and extends parallel with an axis of rotation 18 of the cylinder 1, is disposed at an end 17, close to the plate cylinder, of the upper wall 13 of the printing plate perparation device 12. The end 17, close to the plate cylinder, of the upper wall 13 is designed approximately parallel with a tangent 21, which is determined by a cylinder surface 22 of the cylinder 1 and the suspension strip 19 of the printing plate preparation device 12.

It is possible, as in the instant example, for a second printing plate preparation device 23 to be disposed besides the first printing plate preparation device 12, whose end 24 close to the plate cylinder is also provided with a suspension strip 26 of nose-shaped cross section and which is embodied approximately parallel with the tangent 21 determined by the cylinder surface 22 of the cylinder 1 and the suspension strip 19 of the first printing plate preparation device 12.

Respectively a right and left linear drive 27, 28 as depicted in FIG. 3, is fastened in the side frames 8, 9 above and parallel with this tangent 21, which for example respectively consists of thread spindles 29, 31, which are rotatably seated in brackets 32, 33, 34, 36 fixed on the frame. It is possible to employ other known linear drives 27, 28, for example belt or chain drives, toothed rack drives, hydraulic or pneumatic servo cylinders or linear motors, in the same manner. A synchronous rotating movement of the threaded spindles 29, 31 is generated by means of a belt 37, for example a toothed belt, which mechanically synchronizes the right and left threaded spindles 29, 31. This synchronization can take place mechanically also by means of chain or drive shafts or electronically via two separate drives 38 of the linear drives 27, 28. The two threaded spindles 29, 31 move a cross arm 39, seen in FIGS. 1 and 2, and which is parallel with the axis of rotation 18 of the cylinder 1, in a transport plane 41 which is located above and approximately parallel with the tangent 21 determined by the cylinder surface 22 of the cylinder 1 and the suspension strip 19 of the printing plate preparation device 12. Threaded nuts 42 are respectively disposed at the two ends of this cross arm 39, so that the cross arm 39 is in an operative connection at right angles with the threaded spindles 29, 31. At least one gripper and pressing device 43 is fastened along this cross arm 39, in the represented example shown in FIG.1 there are provided four gripper and pressing devices 43.

An independently operable gripper and pressing device 43 is associated with each individual printing plate 2 associated with an axial cylinder section. However, in the same way it is also possible by means of an additional linear drive, through which a single gripper and pressing device 43 performs an axial movement along the cross arm 39, to change several printing plates 2 disposed along the cylinder 1 with only a single gripper and pressing device 43.

Figure 2:
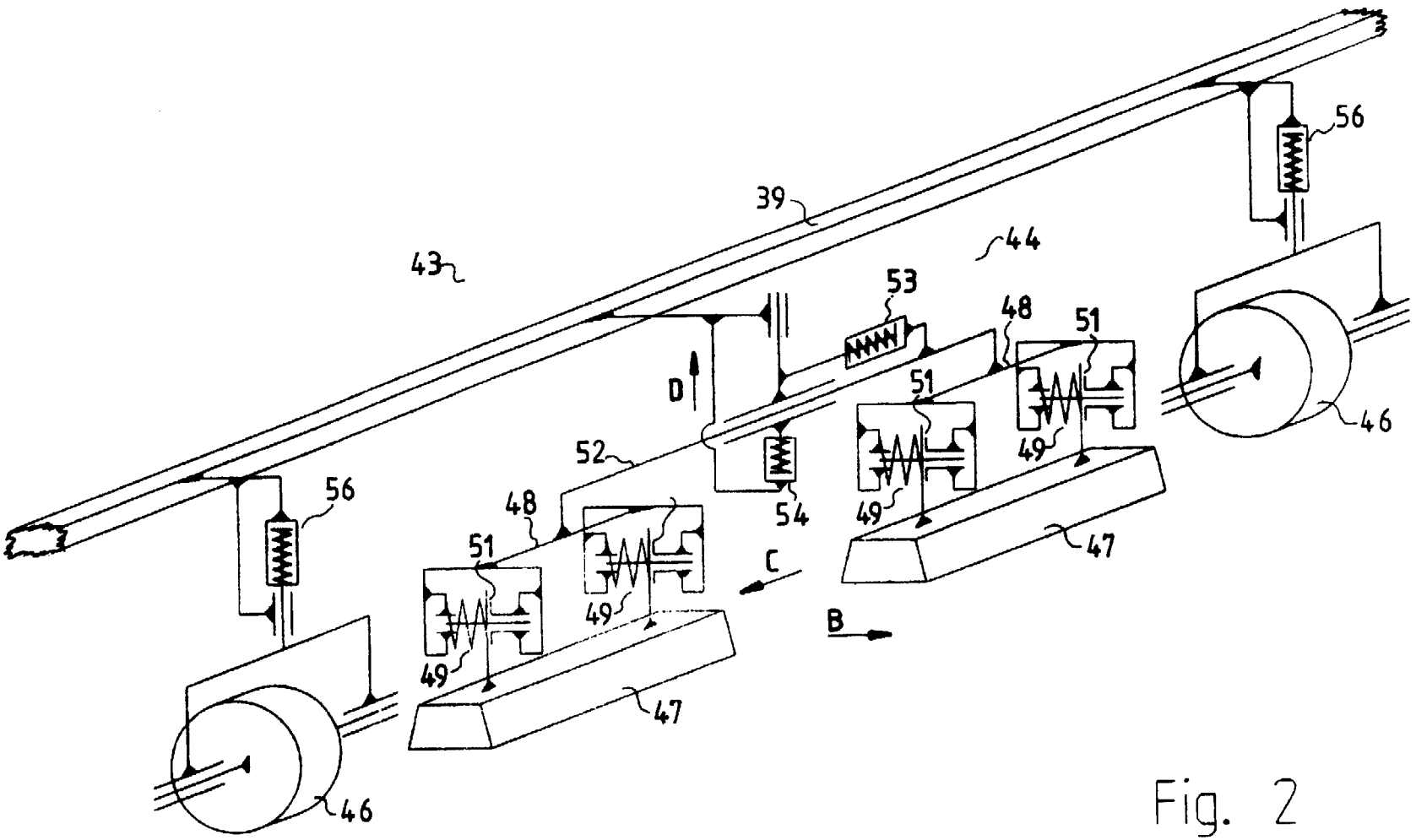

The elements of a gripper and pressing device 43 are represented in FIG. 2:

A gripper and pressing device 43 consists of at least one gripper unit 44 and at least one pressing roller 46. This gripper unit 44 and the pressing rollers 46 are individually displaceable by means of positioning devices independently of each other in respect to the cylinder 1 in the radial direction "D", and the gripper unit 44 additionally also in the axial direction "C".

In the instant example, the gripper and pressing device 43 is constructed approximately symmetrical in respect to the center line of the printing plate 2 extending in the direction of the cylinder circumference:

In each gripper and pressing device 43, a gripper unit 44 is embodied, for example, in the form of two suction strips 47, which are displaceable, secure against relative twisting, perpendicularly in respect to a guide strip 48 opposite the tangential direction "B" of the cylinder 1, and are pushed in the direction "B" against a stop 51 by pressure springs 49.

These guide strips 48 are fastened on a further guide strip 52 and are displaceable opposite the direction "C" by means of a pneumatic cylinder 53. A pneumatic cylinder 54 causes a position change of the guide strip 52 with the suction strips 47 along the direction "D". A pressing roller 46 is respectively located next to the suction strips 47, which can be placed against the printing plate 2 opposite the direction "D" via a pneumatic cylinder 56.

In the instant example, as seen in FIG. 3, four closures 57, 58, 59, 61 are disposed in the cylinder 1 in the axial direction, extending parallel with the axis of rotation 18 of the cylinder 1. The length of the closures 57, 58, 59, 61 respectively is approximately half a cylinder length. These closures 57, 58, 59, 61 are again divided in the width of the plate (i.e. respectively two printing plates 2 are provided per closure 57, 58, 59, 60), and can be independently actuated both within this division and also in respect to each other. The closures 57, 58 are offset in respect to each other by approximately 90° in the circumferential direction of the cylinder 1. A closure 59, 61 is respectively associated with each opposite closure 57, 58.

The mode of functioning of the closures 57, 58, 59, 61 will be explained in more detail below by reference to the closure 57 which is depicted in detail in FIG. 12.

The closure 57 is disposed in a cylinder hole or channel 62 extending parallel with the axis of rotation 18. Respectively one front and one rear suspension strip 63, 64 of a nose-shaped cross section is disposed on the cylinder 1 and delimits the cylinder hole or channel 62 beneath the cylinder surface 22. The closure 57 has a right and a left clamping flap 66, 67. Each one of these clamping flaps 66, 67 extends approximately over the width of the plate in the axial direction along the axis of rotation 18 of the cylinder 1. The cross section of both clamping flaps 66, 67 is embodied circular arc-shaped on its lower end as a seating place, from which a lever 69 projects, which terminates in a hook-shaped nose 71. In the opened state of the clamping flaps 66, 67, their noses 71 are located below the cylinder surface 22, and their sides 72 facing the suspension strips 63, 64 of the cylinder 1 are beveled in correspondence with the suspension strips 63, 64 of the cylinder 1, so that in the opened state the clamping flaps 66, 67 are essentially covered by the suspension strips 63, 64.

In the clamped state of the clamping strip 67, a side 73 of the nose 71 of the clamping flap 66 facing the beveled suspension edge 4 of the pressure plate 2 extends approximately parallel with the beveled suspension edge 3 of the printing plate 2. The circular arc-shaped end 68 is respectively seated pivotably in a circular arc-shaped recess 74 of the cylinder hole or channel 62, which extends parallel with the axis of rotation 18. Under the action of springs, the clamping flap 67 performs a pivot movement in the direction towards the rear beveled suspension edge 4 of the printing plate 2 which is to be clamped. In the instant example, the circular arc-shaped end 68 of the clamping flap 67 is provided with a bore 77, through which a rod-shaped torsion spring (torsion bar) 76 extends. On one of its ends, this torsion bar 76 is rigidly connected with the cylinder 1, while its second end is fixed in place on one end of the clamping flap 67.

It is possible, as in the described example, for a further clamping flap 66 to be disposed axially symmetrical in respect to a center line 78 opposite this clamping flap 67 (so that it is also possible to operate in the opposite direction of rotation of the cylinder 1), or only a filler could be inserted. A device generating a force acting on the lever 69 of the two clamping flaps 66, 67 is disposed between these two clamping flaps 66, 67 or the filler. In the instant example, a non-elastic, inflatable hose 79 is disposed between the two clamping flaps.

With the clamping flaps 66, 67 closed, i.e. with a clamped printing plate 2, this hose 79 is compressed flat between the clamping flaps 66, 67. If this hose 79 is charged, for example with compressed air, by means of the change of the shape of the hose 79 it generates a force acting opposite the torsion bar 76 on the lever 69 of the clamping flaps 66, 67 and they therefore pivot in the direction of the insertion strips 63, 64 of the cylinder 1, because of which the closure 57 opens and the beveled insertion edge 4 of the printing plate 2 comes free.

The changing process of a printing plate 2 will be explained in more detail by reference to means of FIG. 2 to FIG. 11:

The cross arm 39 with the gripper and pressing device 43 is moved from a parked position into its unclamping position by the two linear drives 27, 28, while the cylinder 1 rotates into its unclamping position. The unclamping position of the cross arm 39 is determined in that the cross arm 39 is located approximately on or close to a perpendicular line 81, drawn from the axis of rotation 18 of the cylinder 1 to the threaded spindles 29, 31 of the linear units 27, 28. Thus, in this unclamping position the pressing rollers 46, which later are placed against the printing plate 2, determine a loosening point 82 of the printing plate from the cylinder 1 in such a way that a tangent 83 applied in the loosening point 82, i.e. the printing plate 2, as seen in FIG. 4 terminates in the chute 16 of the printing plate preparation device 12. The unclamping position of the cylinder 1 as seen FIG. 3 is determined in that the described perpendicular line 81 forms an angle of approximately 10° opposite the production direction with a connection line formed by a center line 78 of the closure 57 and the axis of rotation 18. The parked position of the cross arm 39 with the gripper and pressing device 43 is located in the transport plane 41, viewed in the plate feed direction A, at least sufficiently far behind the perpendicular line 81 extending from the axis of rotation 18 of the cylinder 1 to the threaded spindles 29, 31, that manual printing plate changes, for example, can be performed, for example 100 mm to 200 mm. Thus the parked position is located outside of the plate transport path. The two pressing rollers 46 are pressed on the loosening point 82 of the printing plate 2 by the pneumatic cylinders 46 in order to prevent slippage of the printing plate 2 on the cylinder 1 as seen in FIG. 4. Thereafter a closure 57 of the cylinder 1 opens and the cylinder starts to turn opposite the production direction "P"(FIG. 3). Because of the inherent stiffness of the printing plate 2, it springs out of the closure 57 which, following a rotating movement of the cylinder 1 of approximately 10°, closes again.

Figure 5:
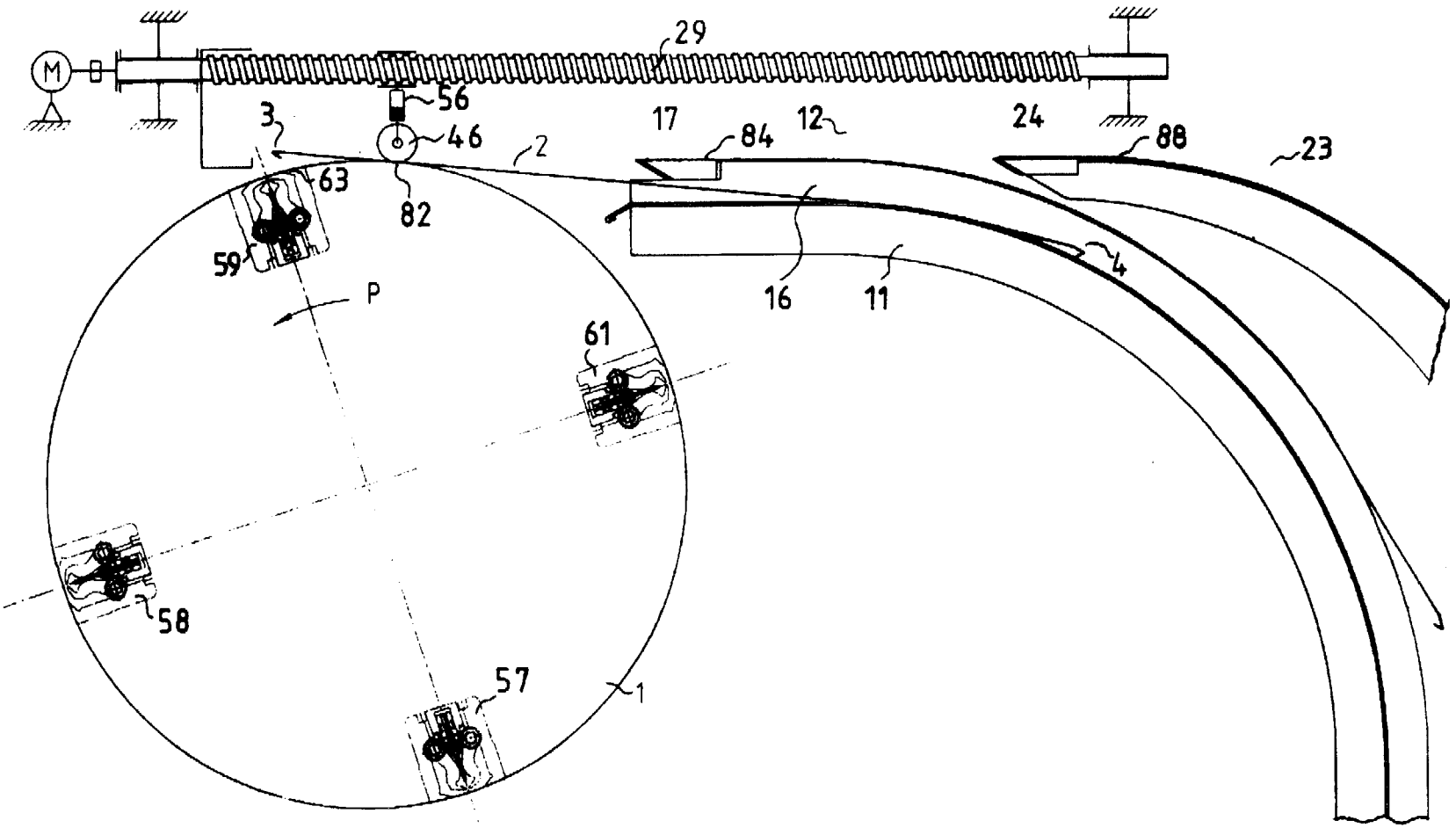

During the rotating movement of the cylinder 1, the printing plate 2 is guided on the cylinder 1 in a frictionally connected manner because of the force effect of the pressing rollers 46, and in this way the printing plate end reaches the chute 16 of the inking unit protector 11. The cylinder 1 stops as seen in FIG. 4 approximately 10° to 30° before the front suspension strip 63 of the cylinder 1 reaches the pressing rollers 46, and the printing plate 2 is fixed in place in the chute 16 by means of a not further shown device. Thereafter, the cylinder 1 turns at least far enough against the production direction "P", because of which the printing plate 2 is displaced on the cylinder 1, until the printing plate 2 springs out of the suspension strip 63 because of its inherent torsion as shown in FIG. 5. The pressing rollers 46 are drawn back from the cylinder 1 by means of the pneumatic cylinders 56.

The printing plate is subsequently removed from the cylinder 1 by means of a device, not shown, in the chute 16 and is completely transported into the chute 16.

Figure 6:
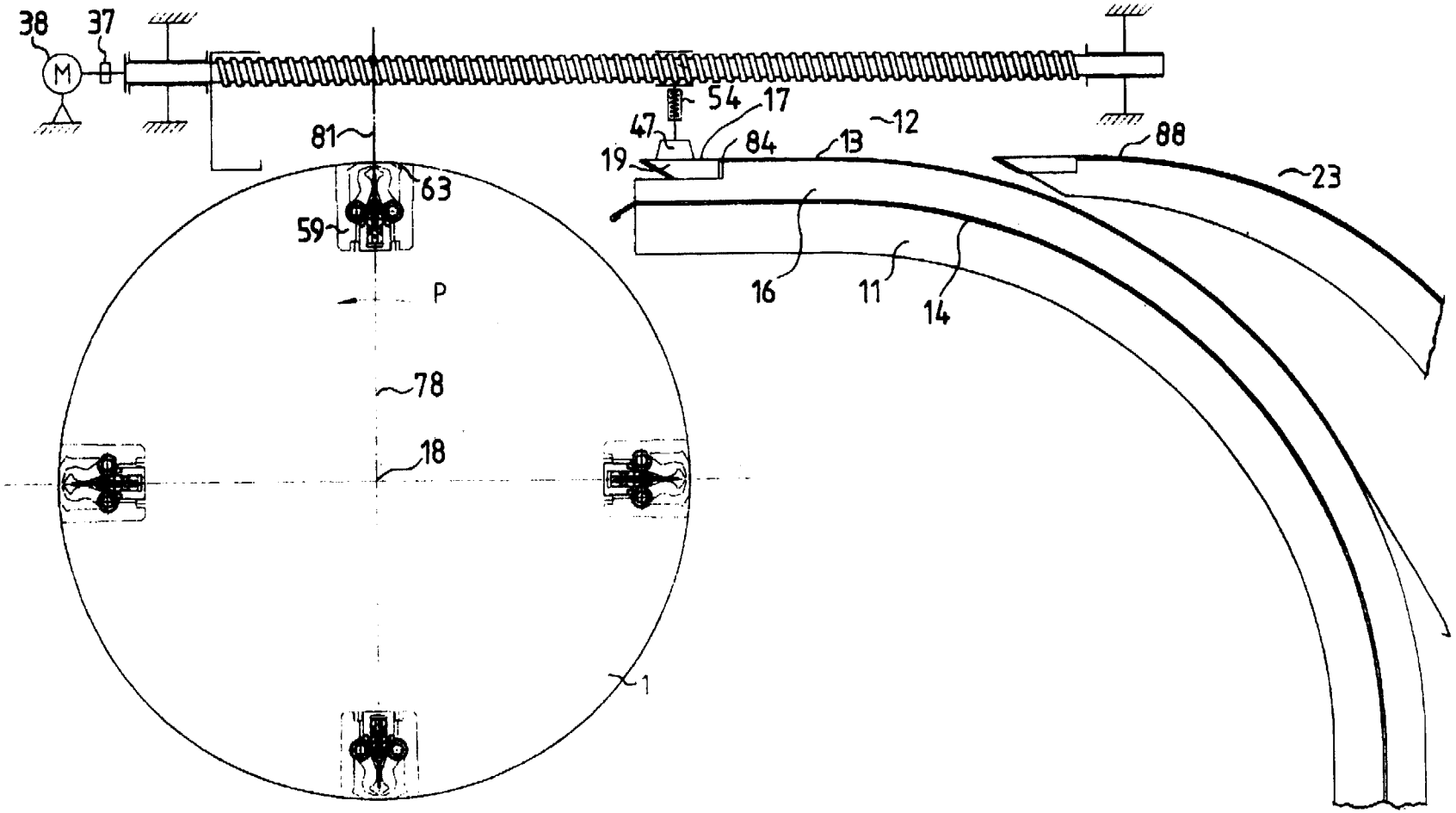

For clamping a fresh printing plate 84, as seen in FIG. 6 the cylinder 1 turns into its initial position which is determined in that the center line 78 of the closure 57 is approximately congruent with the perpendicular line 81 extending perpendicularly with the movement direction of the linear drives 27, 28 from the axis of rotation 18. The cross arm 39 is brought into a position for receiving the fresh printing plate 84 by means of the two linear drives 27, 28, i.e. the suction strips 47 are located in the area of the end close to the plate cylinder of the printing plate preparation device 12. The gripper unit 44 is displaced opposite the direction "C" by charging the pneumatic cylinder 53 with air.

The printing plate 84 to be newly applied had been placed pre-positioned on the upper wall 13 and on the suspension strip 19 of the printing plate preparation device 12.

The suction strips 47 are lowered to the level of the printing plate 84 by bleeding the air from the pneumatic cylinders 54 and are charged with suction air, as seen in FIG. 6. By means of this, the printing plate 84 is fixed with its printing side on the gripper and pressing device 43. The cross arm 39 is now moved in the direction toward the cylinder 1 and after a distance of approximately 10 mm has been traveled, the suction strips 47 with the printing plate 84 are lifted by means of the pneumatic cylinders 54.

Figure 7:
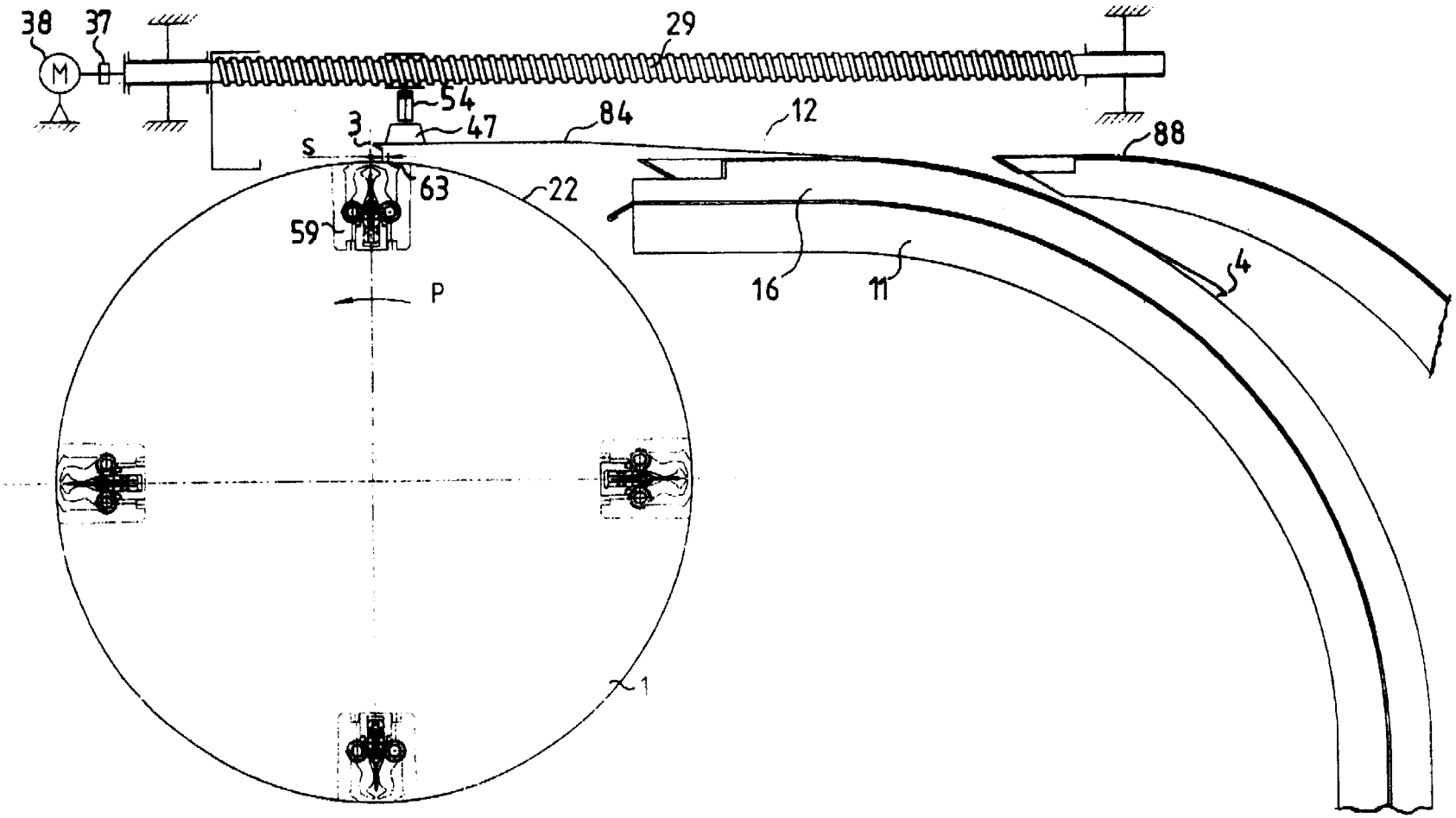

The cross arm 39 with the gripper and pressing device 43 conveys the printing plate 2 in the direction toward the front suspension strip 63 of the cylinder 1 until the front beveled suspension edge 3 of the printing plate 84 forms a gap "s" with the suspension strip 63 of the cylinder 1, so that the gripper unit 44 with the suction strips 47 can lower the printing plate 84 by means of the pneumatic cylinder 54 on the cylinder surface 22 as seen in FIG.7. This gap "s" is approximately 2 mm to 5 mm.

Figure 8:
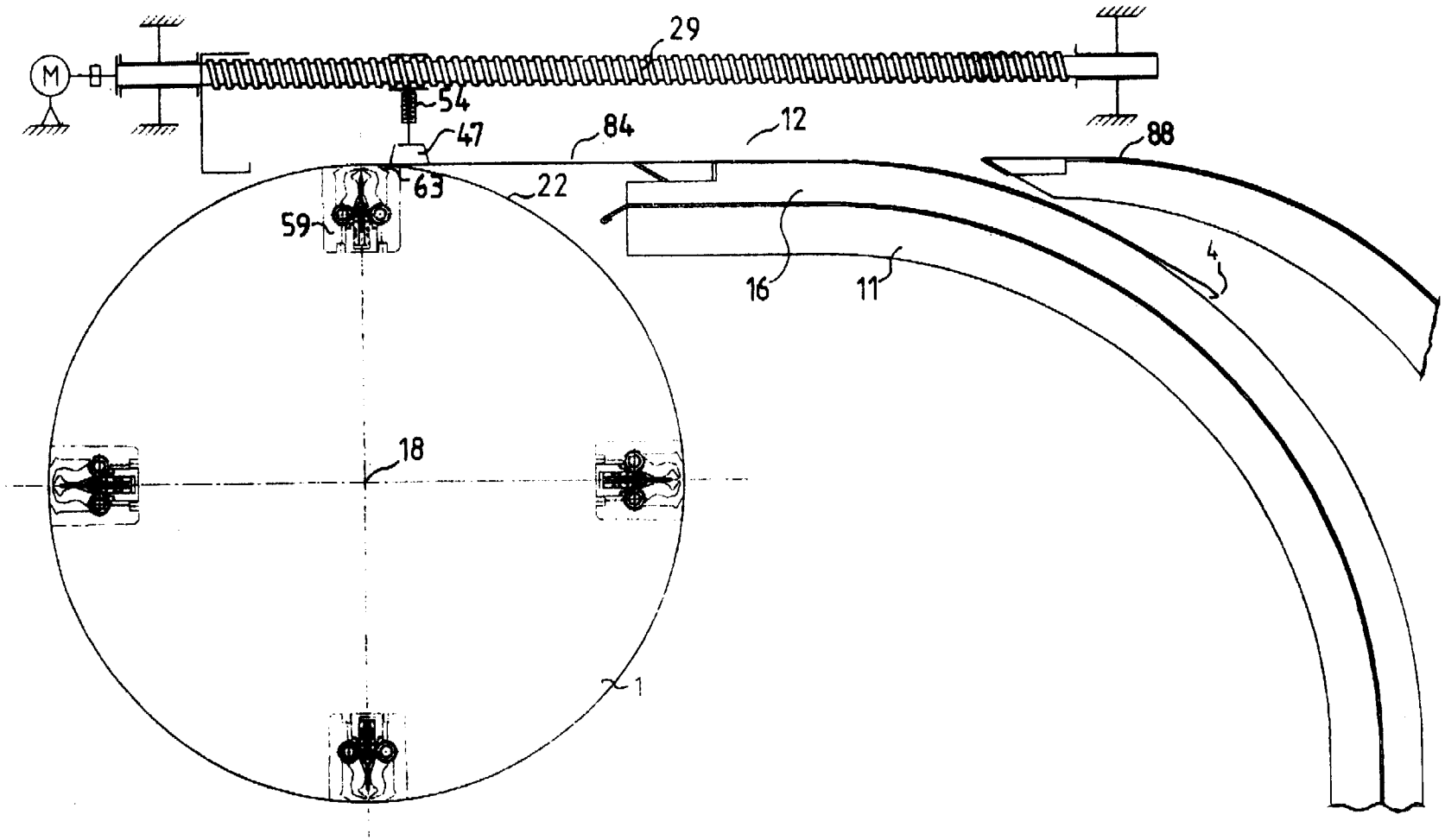

Following the lowering of the printing plate 84, the linear drives 27, 28 move the gripper and pressing device 43 opposite the direction "A" until the front beveled suspension edge 3 of the printing plate 84 rests exactly against the suspension strip 63 of the cylinder 1 and the suction strips 47 pre-stress the printing plate 84 with a defined force opposite the direction "B". This is shown in FIG. 8.

Figure 12:
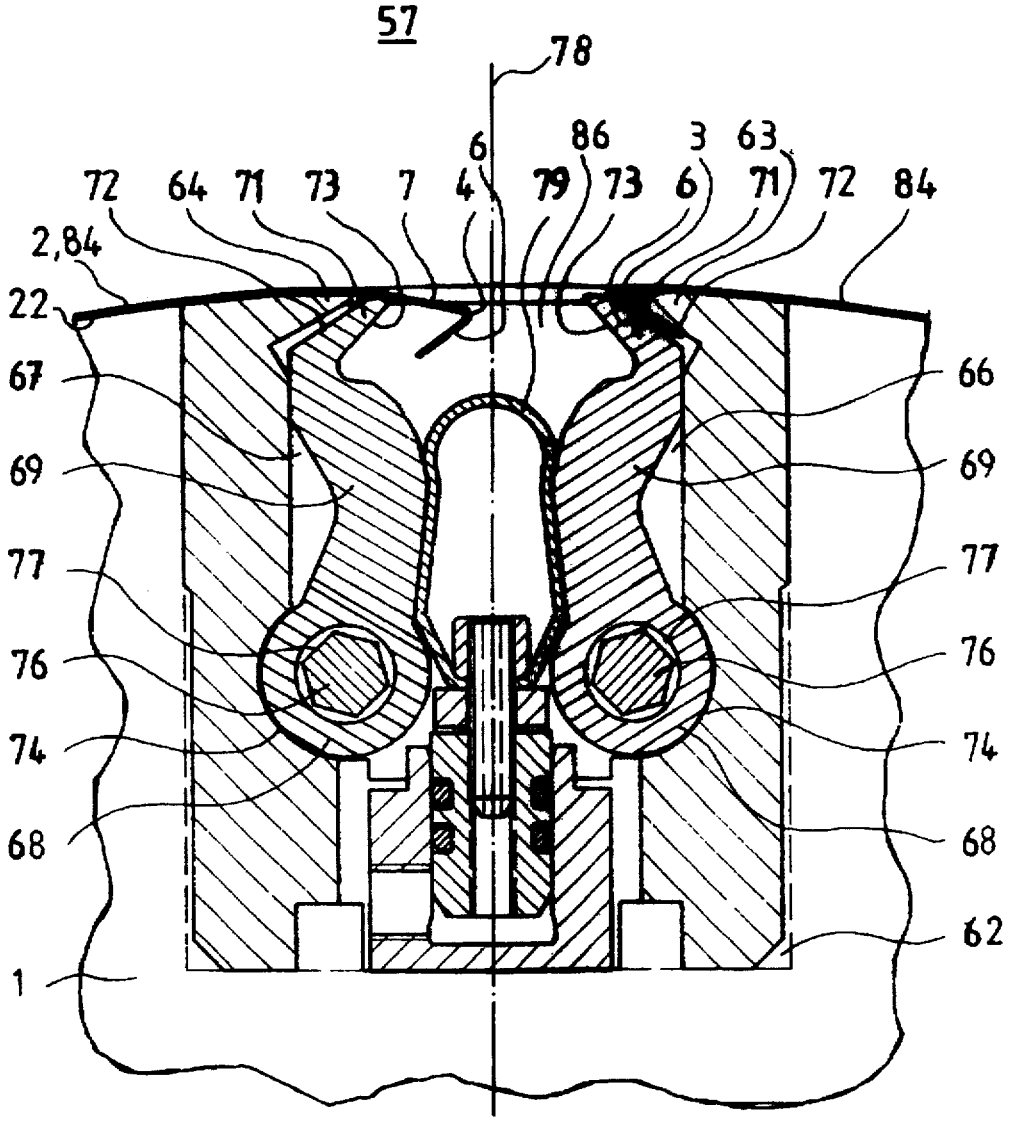

Subsequently the printing plate 84, which is held by the suction strips 47, is positioned axially and parallel with an axis of rotation 18 of the cylinder 1 on a respective lateral register stop 86 which is shown in FIG. 12 with a defined force, for example resiliently, by actuating the pneumatic cylinder 53, so that the printing plate 84 rests securely against the lateral register stop 86, but is not deformed. The spring force for positioning the printing plate 84 can be generated, for example, by means of the spring of a single-acting pneumatic cylinder 53 or by the air pressure (for example adjustable by means of pressure regulators) of a double-acting pneumatic cylinder. The lateral register stops 86 are fixed with the cylinder on the suspension strip 63 of the cylinder 1 below the cylinder face 22. In the example shown, a common lateral register stop 86 is located on the left or right lateral edge of the printing plate 84 associated with the respective cylinder section.

The described functioning of the pneumatic cylinder 53 applies in case of the disposition of the lateral register stop 86 on on the left lateral edge, i.e. in the direction C. In case of the disposition of the lateral register stop 86 on the right lateral edge, the pneumatic cylinder 53 must act in the opposite direction.

Afterwards, the two pressing rollers 46 are lowered by means of the respective pneumatic cylinders 56 on the printing plate 84. The suction air of the suction strips 47 is shut off and the suction strips 47 are lifted in the direction "D" by charging the pneumatic cylinder 54 with suction air, as may be seen in FIG. 9.

Figure 10:
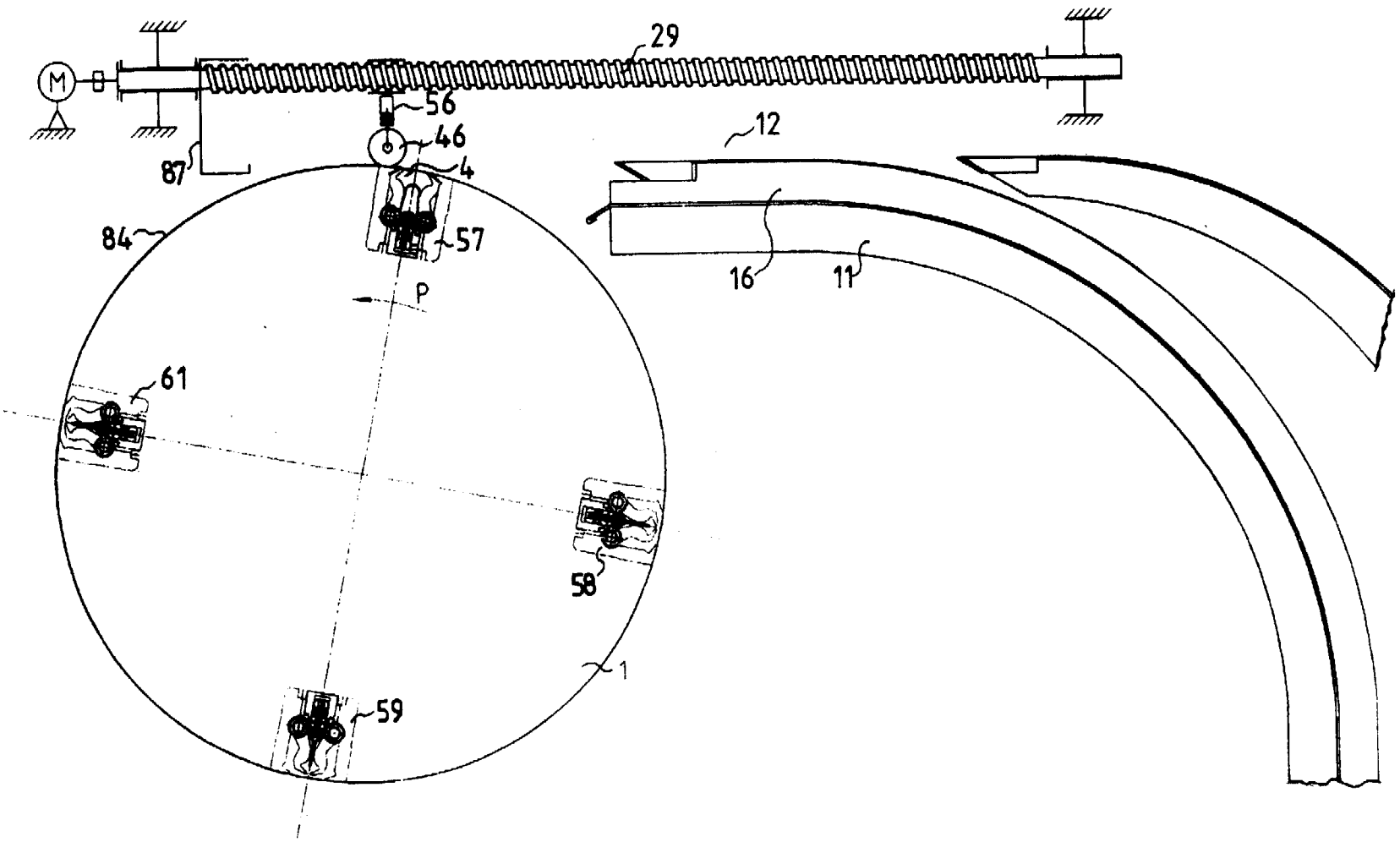
Figure 11:
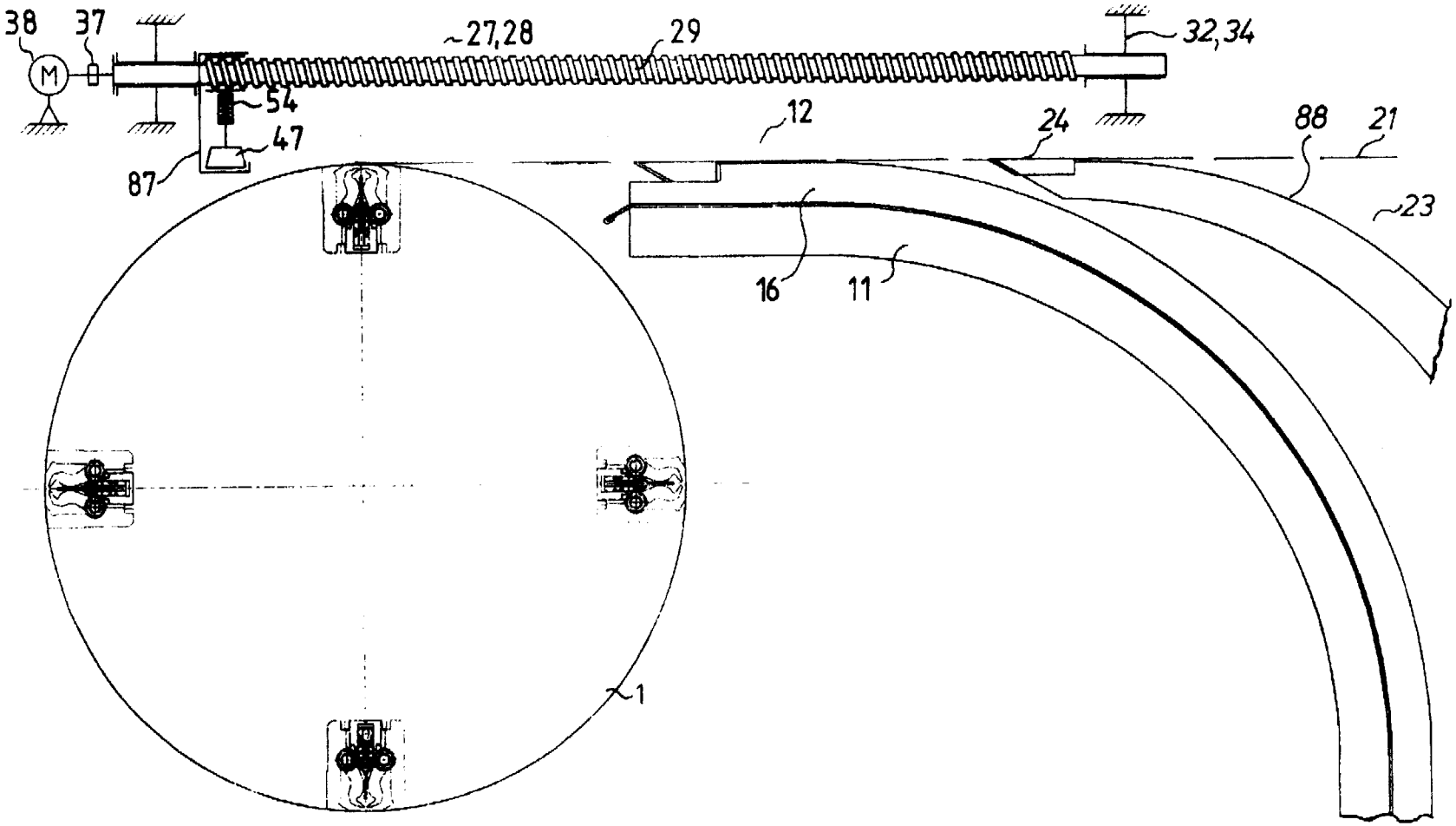

Thereupon the cylinder 1 turns in the production direction "p" until the pressing rollers 46 are located approximately 10° to 20° ahead of the rear beveled suspension edge 4 of the printing plate 84, whereupon the closure 57 opens, as shown in FIG. 10. Subsequently, the cylinder 1 turns approximately 5° to 10° in the production direction "P" and the printing plate 84 is clamped on the cylinder 1 by closing the closure 57. The pressing rollers 46 are raised and the cross arm 39 with the gripper and pressing device 43 moves into the parked position. There the pneumatic cylinder 54 is bled and the gripper unit 44 is lowered, as depicted in FIG. 11. In this parked position, the gripper and pressing device 43 is surrounded by a protector 87 which is closed on at least three sides and is protected there against dirt and ink.

Alternatively, it is possible to perform a further plate change in the described manner. For this purpose, the second printing plate preparation device 23 is disposed next to the first printing plate preparation device 12, so that the end 24, close to the cylinder, of the printing plate preparation device 23 is also embodied for positioning a second, fresh printing plate 88 approximately parallel with the tangent 21 of the cylinder surface 22.

Corresponding to the first described removal process, the chute 16 of the first preparation device 12 receives a second, used printing plate 2.

For mounting the second, fresh printing plate 88 it is placed pre-positioned on the second preparation device 23, and the mounting process takes place in a manner equivalent to the first one.

We claim:

1. A device for mounting, removing and transporting an easily bendable, curved printing plate with front and rear, dimensionally stable beveled suspension edges which are resistant to being bent open, and whose respective legs form an opening angle (alpha) of less than 90°, on and from a cylinder of a rotary printing press, which has at least one suspension strip of a nose-shaped cross section and a closure which engages said rear beveled suspension edge of the printing plate and which has pivotable resilient clamping flaps comprising:

at least one printing plate preparation device positioned near the plate cylinder and fixed on a press frame and which can receive at least one pre-positioned printing plate;

a cross arm with at least one gripper and pressing device disposed so it can be positioned in a transport plane by means of a positioning device having linear drives, and wherein the transport plane lies approximately parallel with and above a tangent determined by a cylinder surface of the cylinder and a suspension strip of the printing plate preparation device; and a gripper unit in said at least one gripper and pressing device and equipped with suction strips acting on the printing side of the printing plate, said gripper unit, starting at the transport plane, being disposed movable away from and toward a suspension strip of the cylinder, said gripper unit being movable parallel with an axis of rotation of the cylinder along the suspension strip of the cylinder in such a way that a printing plate fixed on said gripper unit can be pressed with a definable force against lateral register stops disposed on the suspension strip of the cylinder.

2. The device in accordance with claim 1, wherein said gripper unit is equipped with suction strips which are resiliently displaceable parallel with a linear movement direction of said gripper and pressing device.

3. The device in accordance with claim 1, wherein said gripper unit can be axially positioned by means of a pneumatic cylinder.

4. The device in accordance with claim 1, characterized in that for receiving the printing plate, an end, close to the plate cylinder, of said printing plate preparation device is approximately parallel with the tangent of the cylinder surface and with said suspension strip of said printing plate preparation device.

5. The device in accordance with claim 1, characterized in that said gripper and pressing device consists of at least one said gripper unit and at least one pressing roller.

6. The device in accordance with claim 1, wherein said positioning device; of said gripper and pressing device is constituted by two said linear drives which are synchronized with each other.

7. The device in accordance with claim 6, wherein said two linear drives each consist of one threaded spindle and a threaded nut fastened on said cross arm, and further wherein said two threaded spindles are connected with each other by means of a toothed belt and are synchronized.

8. The device in accordance with claim 6, wherein said two linear drives each consist of one toothed belt drive and that these two toothed belt drives are connected by means of a drive shaft, and are synchronized.

9. The device in accordance with claim 6, wherein said two linear drives each have their own drive and are electrically synchronized.

10. The device in accordance with claim 5, wherein said at least one pressing roller can be radially positioned with respect to the cylinder by means of a pressing roller positioning device.

11. The device in accordance with claim 10, characterized in that said positioning device consists of pneumatic cylinders.

12. The device in accordance with claim 1, wherein said printing plate preparation device is embodied as a part of an inking unit protector.

13. The device in accordance with claim 1, further including a second printing plate preparation device which is disposed with an end close to the cylinder and which is embodied for positioning a second printing plate approximately parallel with the tangent of the cylinder surface and the suspension strip of said first printing plate preparation device.

14. A device for mounting, removing and transporting an easily bendable, curved object with front and rear, dimensionally stable beveled suspension edges which are resistant to being bent open, and whose respective legs form an opening angle of less than 90°, on and from a cylinder of a rotary printing press, which has at least one suspension strip of a nose-shaped cross section and a closure which engages said rear beveled suspension edge of the curved object and which has pivotable resilient clamping flaps comprising:

at least one curved object preparation device positioned near the plate cylinder and fixed on a press frame and which can receive at least one pre-positioned curved object;

a cross arm with at least one gripper and pressing device disposed so it can be positioned in a transport plane by means of a positioning device having linear drives, and wherein the transport plane lies approximately parallel with and above a tangent determined by a cylinder surface of the cylinder and a suspension strip of the curved object preparation device; and a gripper unit in said at least one gripper and pressing device and equipped with suction strips acting on a first side of the curved object, said gripper unit, starting at the transport plane, being disposed movable away from and toward a suspension strip of the cylinder, said gripper unit being movable parallel with an axis of rotation of the cylinder along the suspension strip of the cylinder in such a way that a curved object fixed on said gripper unit can be pressed with a definable force against lateral register stops disposed on the suspension strip of the cylinder.

15. The device in accordance with claim 14 wherein said bendable curved object is a metal support plate with a rubber blanket fastened by adhesion to said support plate.

* * * * *